US006272424B1

(12) United States Patent
Yoshida et al.

(10) Patent No.: US 6,272,424 B1
(45) Date of Patent: Aug. 7, 2001

(54) ENGINE CONTROL APPARATUS INCLUDING INTERPOLATION CONTROL MEANS

(75) Inventors: Yoshiyuki Yoshida; Hidefumi Iwaki, both of Hitachinaka; Masahiro Iriyama, Yokohama, all of (JP)

(73) Assignees: Hitachi, Ltd., Tokyo; Nissan Motor Co., Ltd., Yokohama, both of (JP)

( * ) Notice: Subject to any disclaimer, the term of this patent is extended or adjusted under 35 U.S.C. 154(b) by 0 days.

(21) Appl. No.: 09/405,111

(22) Filed: Sep. 27, 1999

(30) Foreign Application Priority Data

Sep. 25, 1998 (JP) ..... 10-271661

(51) Int. Cl.[7] ..... F02B 17/00; F02D 41/04; G06G 7/06

(52) U.S. Cl. ..... 701/103; 701/105; 701/115; 123/295

(58) Field of Search ..... 123/295, 305; 701/101, 102, 103, 104, 105, 114, 115

(56) References Cited

U.S. PATENT DOCUMENTS 5,268,842 * 12/1993 Marston et al. ..... 701/105
5,992,372 * 11/1999 Nakajima ..... 123/295
6,026,779 * 2/2000 Obata et al. ..... 123/295
6,058,905 * 5/2000 Nagaishi et al. ..... 123/295
6,062,190 * 5/2000 Nakajima ..... 123/295

* cited by examiner

*Primary Examiner*—Willis R. Wolfe
(74) *Attorney, Agent, or Firm*—Crowell & Moring, L.L.P.

(57) ABSTRACT

An engine control apparatus including an interpolation control means comprises an interpolation control unit including a desired value calculation part for calculating a desired value of a controlled variable corresponding to each operational state based on related control parameters; a state determination part for determining a change in the operational state of the engine; a interpolation coefficient calculation part for calculating changes of an interpolation coefficient of the controlled variable; and an interpolated desired value calculation part for calculating the interpolated desired value of the controlled variable based on the interpolation coefficient and two desired values of the controlled variable in the first and second operational states; wherein the interpolation control unit controls the controlled variable in switching of the operational state from the first to the second state in the engine.

7 Claims, 11 Drawing Sheets

A/F:AIR TO FUEL RATIO

A/F:AIR TO FUEL RATIO

ENGINE CONTROL APPARATUS INCLUDING INTERPOLATION CONTROL MEANS

BACKGROUND OF THE INVENTION

The present invention relates to an engine control apparatus including an interpolation control means, and especially to an engine control apparatus including an interpolation control means such that, when the required operational state is switched between one state to another state, a desired value of a controlled variable can be smoothly changed from a desired value of the controlled variable in the one state to that in another state.

In engine control, it is necessary to switch an operational state of an engine in response to an operational requirement corresponding to a change in a running state of a vehicle with the engine. In the switching of an operational state, since a desired value of a controlled variable in one operational state differs from that in another operational state, the switching of an operational state of an engine has been generally performed by searching a prepared map and so on in which the relationship between a desired value of a controlled variable and each operational state of the engine is described.

The above engine control is explained below by taking up a fuel burning (referred to simply as burning) control in an engine as an example. In a direct injection engine, a lean-burn operation is performed. In the lean-burn operation, a stoichiometric mixture burning in the vicinity of the stoichiometric air to fuel ratio (homogeneous charge burning) or a lean air to fuel ratio mixture burning (stratified charge burning) is selected corresponding to a change of an operational state such as a change in a required load for an engine.

In the above lean-burn operation, since fuel is burn at a superlean air to fuel ratio (hereafter, referred to as A/F), the fuel consumption cost can be greatly reduced, and the gas exhaust performance can be improved. However, in order to burn fuel at a superlean A/F in the engine, it is necessary to inject highly-pressurized fuel into each cylinder of the engine. Although the fuel pressure to inject fuel into cylinders of an engine is often set as constant, it is also required to change the fuel pressure corresponding to a fuel burning state from the point of view of sufficiently bring out the burning performance of the engine. In a conventional burning control, to satisfy the above requirement, a map search method has been generally used. This method uses a prepared map in which the relationship between a desired value of the fuel pressure and each burning state of the engine is described, and if the switching of a burning state is required, a desired value of fuel pressure is selected by searching the map, and the burning state is stepwise switched by changing the desired value of fuel pressure.

If the fuel pressure to inject fuel into cylinders of an engine is changed, when the required burning state is switched, the desired value of the fuel pressure should be smoothly changed from a desired value in the present burning state to that in another burning state, these desired values being described in a map. Such a burning control is especially required from the standpoint of the burning stability. As mentioned above, if the desired value of fuel pressure is stepwise changed, the actual fuel pressure also rapidly changes, which degrades the burning controllability, and may cause stopping of fuel burning or engine shock.

SUMMARY OF THE INVENTION

The present invention has been achieved in consideration of the above described subjects, and is aimed at providing an engine control apparatus including an interpolation control means wherein, when an operational state is required to be changed, a desired value of a controlled valuable is smoothly switched to that of the required operational state of an engine in various kinds of engine operations including a burning operation in the engine.

To attain the above object, the present invention provides an engine control apparatus including an interpolation control means basically applicable to control changing an operational state of an engine to a required one of various kinds of operational states, the engine control apparatus comprising:

an interpolation control unit including;

desired value calculation means for calculating a desired value of a controlled variable corresponding to each operational state based on related control parameters of an engine;

determination means for determining changes of the operational state of the engine;

interpolation coefficient calculation means for calculating an interpolation coefficient of the controlled variable for an interpolated desired value of the controlled variable between desired values in a first operational state and a second operational state to which the operational state of the engine is switched from the first operational state; and interpolated desired value calculation means for calculating changes of the interpolated desired value of the controlled variable based on changes of the interpolation coefficient and two desired values of the controlled variable in the first and second operational states;

wherein the interpolation control unit controls the controlled variable in switching of the operational state from the first state to the second state in the engine with the interpolated desired value whose changes are obtained by the interpolated desired value calculation means corresponding to the operational state determined by the state determination means.

As mentioned above, in accordance with the above engine control apparatus, since an operation state of an engine can be smoothly switched to another operational state by obtaining changes of the interpolated desired value of the controlled variable based on the changes of the interpolation coefficient and two desired values of the controlled value in the first and second operational state, and smoothly changing the operational state of the engine with the interpolated target, it is possible to prevent the control instability which may occur in switching of a desired value of a controlled variable between two different operational states.

Further, the present invention provides an engine control apparatus including an interpolation control means, the engine control apparatus comprising:

an interpolation control unit including;

desired value calculation means for calculating a desired value of fuel pressure corresponding to each burning state based on a quantity equivalent to an engine load and an engine rotational speed;

determination means for determining changes of the operational state of the engine;

interpolation coefficient calculation means for calculating an interpolation coefficient for an interpolated desired value of fuel pressure between desired values in a first burning state and a second burning state to which the burning state of the engine is switched from the first burning state;

interpolated desired value calculation means for calculating changes of the interpolated desired value of the fuel pressure based on changes of the interpolation coefficient and two desired values of the fuel pressure in the first and second burning states;

wherein the interpolation control unit controls the fuel pressure in switching of the burning state from the first to the second state in the engine with the interpolated desired value of fuel pressure, whose changes are obtained by the interpolated desired value calculation means corresponding to the burning state determined by the state determination means.

As mentioned above, in accordance with the above engine control apparatus, since a desired value of fuel pressure can be smoothly transferred to another desired value when the fuel pressure is changed in selecting one of a stoichiometric mixture burning in the vicinity of the stoichiometric A/F (homogeneous charge burning) or a lean A/F mixture burning (stratified charge burning) in the lean-burn operation, it is possible to prevent stopping of fuel burning or engine shock which may be caused in the switching between the two desired values of the fuel pressure.

Moreover, in the above engine control apparatus, the interpolation coefficient is obtained by repeatedly adding or subtracting an optionally set incremental or decremental quantity to or from an initial value of the interpolation coefficient corresponding to a changing state of the operational state; the incremental quantity is set by searching a map or a table corresponding to the operational state; the timing of adding or subtracting the incremental quantity to or from the present interpolation coefficient is set by searching a map or a table; an upper limit value and a lower limit value are provided in obtaining the interpolation coefficient; the interpolation coefficient is obtained using another incremental quantity when the interpolation coefficient changes beyond a predetermined slice level; and the interpolation coefficient can be calculated with a predetermined time delay after the change of the operational state is started.

Furthermore, in the above engine control apparatus, the first and second desired values of the controlled variable before and after the operational state switching, for example, the first and second desired values of the fuel pressure before and after the burning state switching, are set by searching a desired value map or a desired value table which is expressed with two parameters of the quantity equivalent to the engine load and the engine rotational speed.

DETAILED DESCRIPTION OF THE EMBODIMENTS

Hereafter, details of the embodiments according to the present invention will be explained with reference to the drawings.

Figure 1:
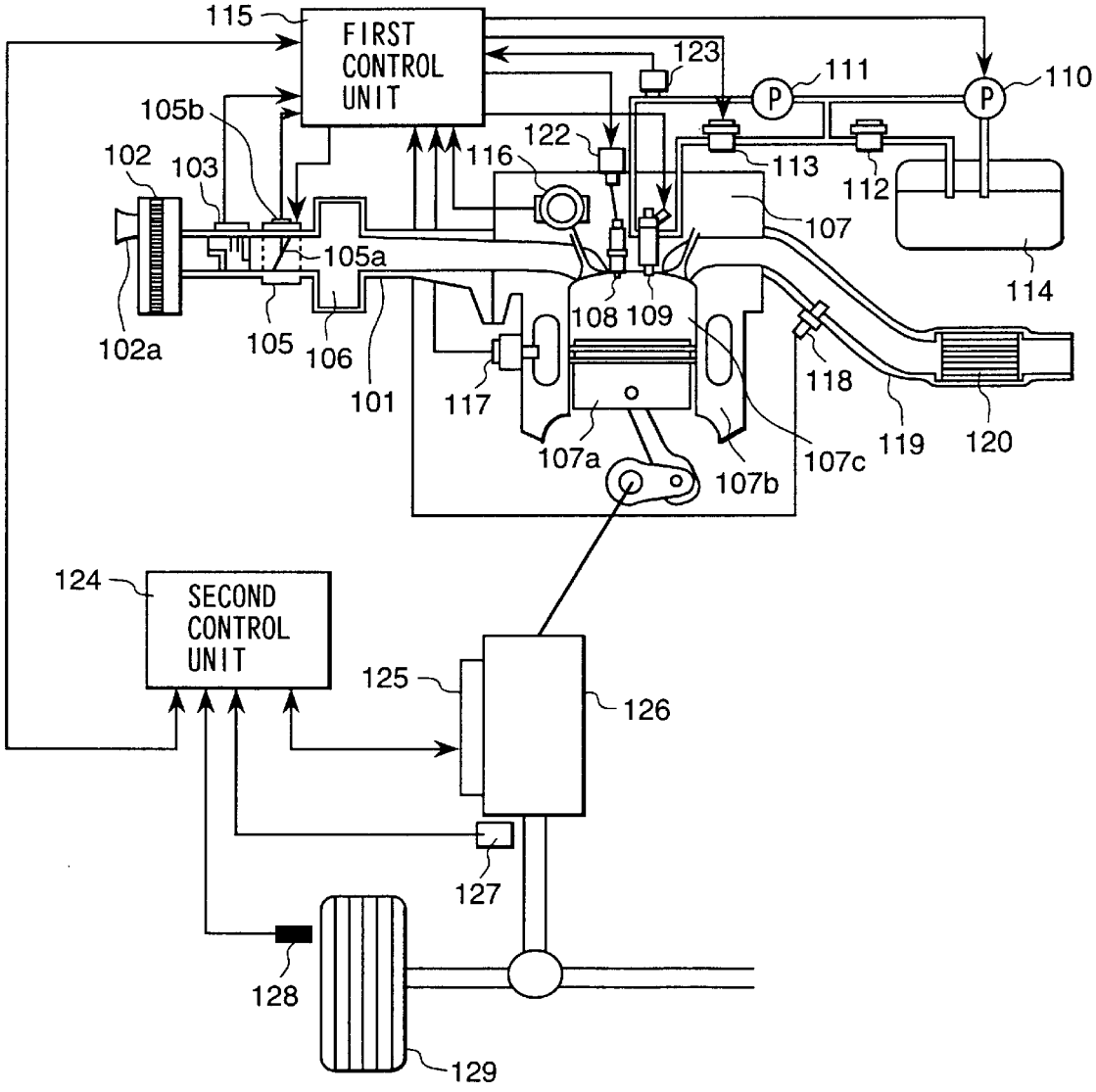
FIG. 1 is a diagram showing the whole composition of an engine control apparatus including an interpolation control means of an embodiment according to the present invention.

FIG. 1 shows the whole composition of a control system for an engine 107 using an interpolation control means of an embodiment according to the present invention. In FIG. 1, air taken in the engine 107 is sucked into the entrance part 102*a* of an air cleaner 102, passes through an air flowmeter 103 and a throttle valve body 105 in which a throttle valve 105 is provided to control the amount of the intake air, and enters a collector 106. The air taken into the collector 106 is distributed to an air intake pipe 101 connected to each cylinder 107*b* of the engine 107, and is led to a combustion room 107*c* of each cylinder 107*b*. Further, a swirl control valve (not shown in this figure) is provided in each air intake pipe 101, and causes swirl flow of the intake air. The throttle valve 105*a* can be opened or closed by a motor (not shown in this figure).

Fuel such as gasoline fed from a fuel tank 114 is first pressurized by a low pressure fuel pump 110, and is second pressurized by a high pressure fuel pump 112. Further, the pressurized fuel is fed to a fuel system including an injector 109, a fuel pressure sensor 123, and an electrically controlled pressure regulator 113.

The pressure of the fuel fed to the fuel system is regulated as a predetermined pressure, and is injected into the combustion room 107*c* from the injector 109 whose injection outlet is opened to the combustion room 107*c* of each cylinder 107*b*. The fuel injected from the injector 109 is ignited by an ignition signal whose voltage is highly increased by an ignition coil 122.

Further, a signal indicating a flow rate of the intake air is output from the air flowmeter 103, and is input to the first control unit 115.

Furthermore, a throttle valve opening sensor 105*b* to detect the opening degree of the throttle valve 105*a* is provided in the throttle valve body 105, and an output signal of the sensor 105*b* is also input to the first control unit 115.

Moreover, a crank angle sensor 116 is rotated by a crank cam axis (not shown in this figure), and an output signal of the sensor 116 is input to the first control unit 115. The timing of fuel injection and the timing of fuel ignition are controlled based on the output signal of the crank angle sensor 116.

Also, an exhaust pipe 119 is connected to the engine 107, and a catalysis device 120 is connected to the exhaust pipe 119. Further, an A/F sensor 118 to detect the concentration of oxygen in exhaust gas is provided in the upper stream of the catalysis device 120, and the detected concentration of oxygen is output from the sensor 118 to the first control unit 115.

Further still, the rotational torque generated by the engine 107 is transmitted to wheels 129 via an automatic transmission 126. The second control unit 124 controls a transmission control device 125 of the automatic transmission 126 composed of oil pressure equipment based on input signals sent from vehicle speed sensor 127, wheel rotational speed sensor 128, and the first control unit 115 to control the engine 107.

Figure 2:
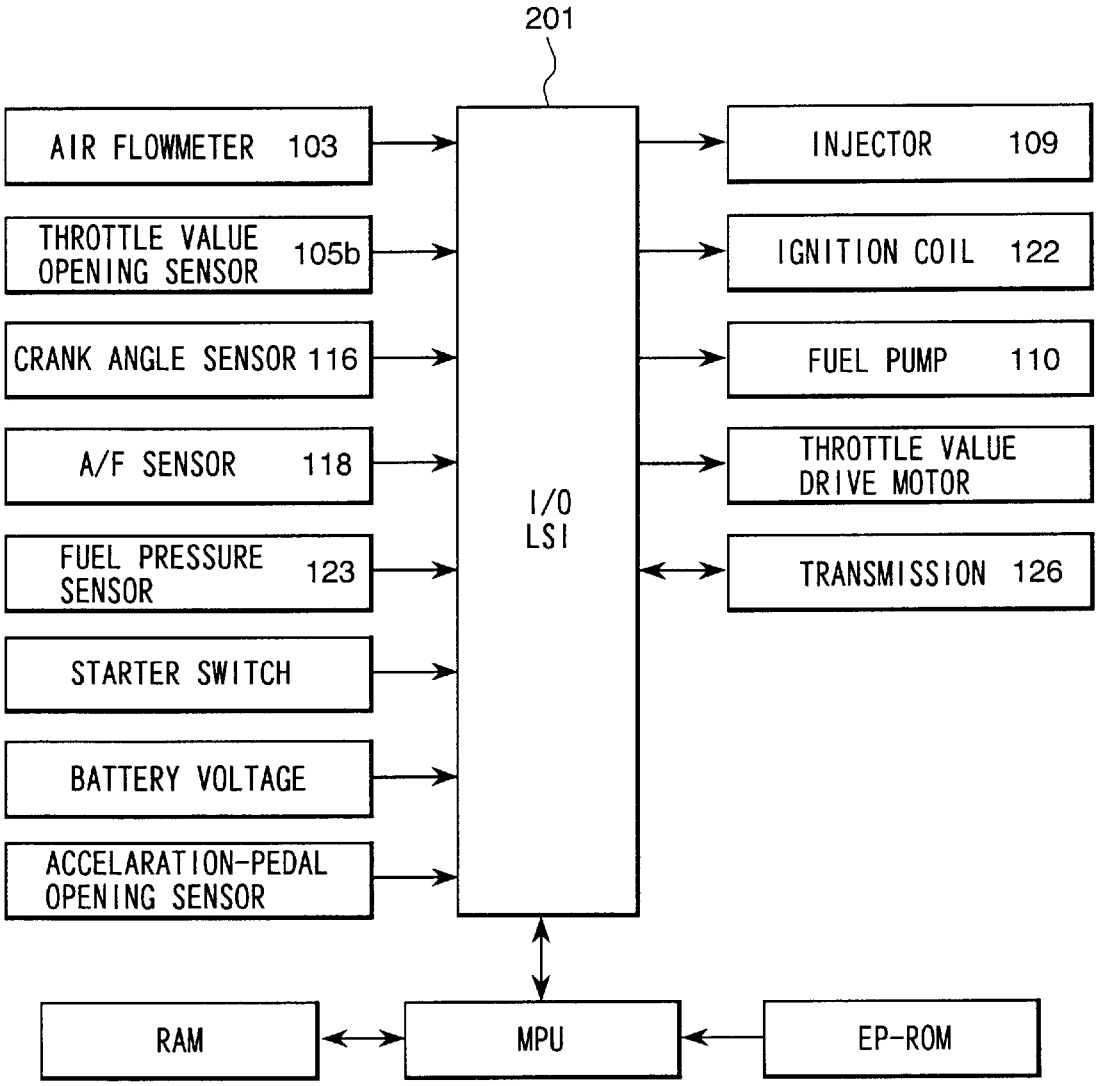
FIG. 2 is a schematic block diagram showing the main composition of the engine control unit (first control unit) shown in FIG. 1.

FIG. 2 shows the main composition of the first control unit 115 including a MPU, a ROM, a RAM, and an I/O LSI 201 with an A/D converter. This first control unit 115 takes in signals output from various sensors to detects operation states of the engine 107, and executes predetermined calculational processing. Further, various control signals obtained as results of the calculational processing are sent to the injector 109, the ignition coil 122, a throttle valve drive motor, and so on, respectively, to perform a fuel feed control, an ignition timing control, an intake air flow rate control, etc. Moreover, the basic composition of the second control unit 124 is the same as that of the first control unit 115, and performs the transmission control by sending a control signal which is obtained based on input signals sent from vehicle speed sensor 127,a wheel rotational speed sensor 128, and the first control unit 115, to control the engine 107.

Figure 3:
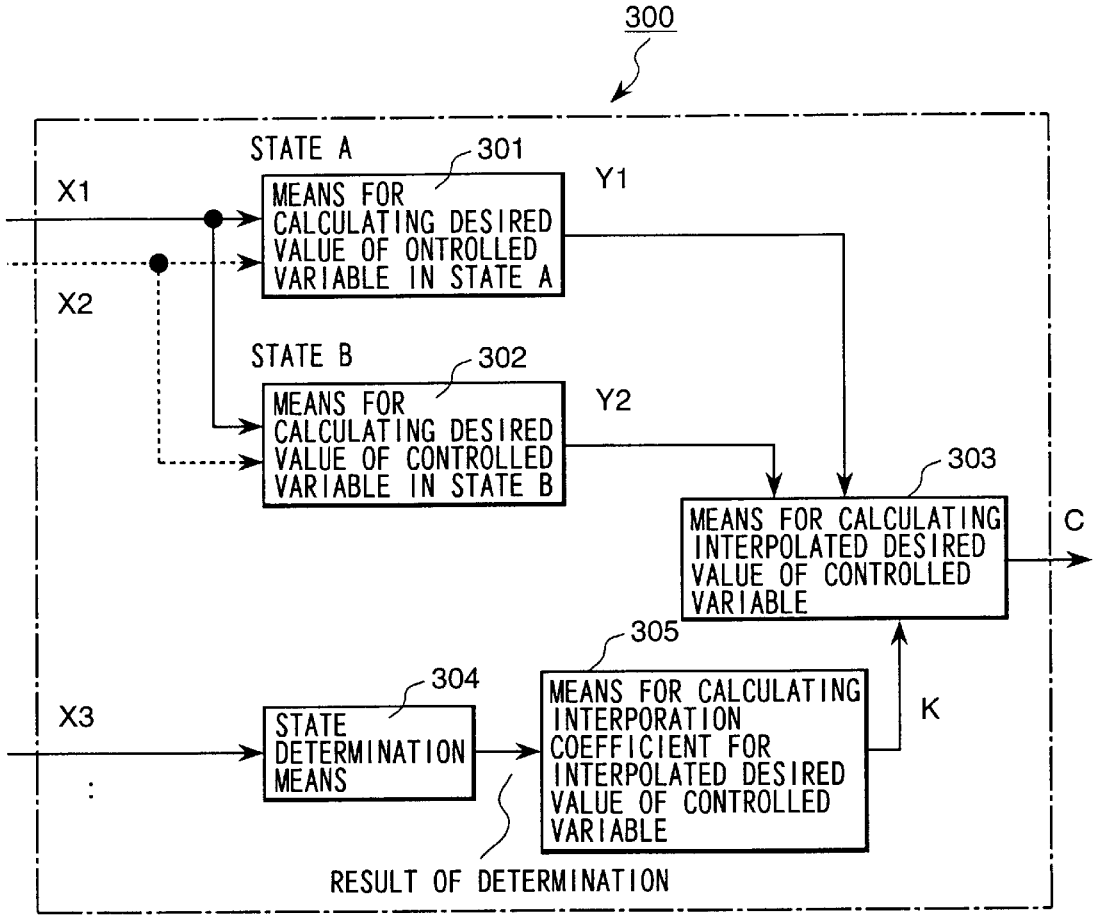
FIG. 3 is a schematic block diagram showing the interpolation control means of the engine control apparatus shown in FIG. 1.

FIG. 3 schematically show the composition of a interpolation control means 300 of the engine control apparatus (the first control unit 115), and also shows an outline of the control performed by the interpolation control means 300. A means 301 for calculating an interpolated desired value of a controlled variable in a state A calculates a desired value Yl of fuel pressure in a specified operational state A, using control parameters X1 and X2 such as the quantity equivalent to an engine load and the engine rotational speed, and a means 302 for calculating an interpolated desired value of a controlled variable in a state B calculates a desired value Y2 of fuel pressure in a specified operational state B in a similar manner.

Further, a state determination means 304 determines whether the present operational state is the specified state A or B based on input signals sent from the engine 107 and operational parameter X3, and a means 305 for calculating an interpolation coefficient for an interpolated desired value of a controlled variable calculates an interpolation coefficient expressing the ratio interpolating the desired values Y1 and Y2 in state transferring of the state A to the state B, or the state B to the state A, which is determined by the state determination means 304 based on the result of the determination performed. If the operation of the engine is not in state transferring, or state transferring is completed, an upper or lower limit value is set to the interpolation coefficient K. A means 303 for calculating an interpolated desired value of an controlled variable calculates an interpolated desired value C of an controlled variable using the desired values Y1 and Y2, and the interpolation coefficient K.

In accordance with the above interpolation control, while a desired value of a controlled value is transferred from the desired value Y1 in the state A to the desired value Y2 in the state B, the operational state of the engine can be smoothly transferred between the desired values Y1 and Y2 of the controlled variable, using the interpolated desired value C.

Figure 4:
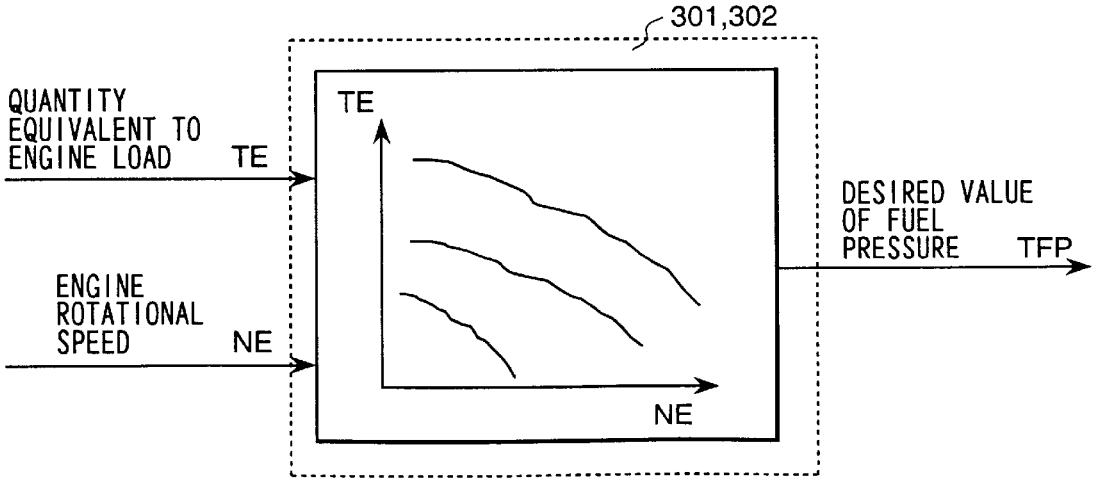
FIG. 4 is a diagram showing an example of a desired value map used by the means for calculating a desired value of a controlled variable in state A or B shown in FIG. 3.

FIG. 4 shows an example of calculating the desired values Y1 and Y2, which is performed by the means for calculating a desired value of a controlled variable in states A and B shown in FIG. 3, using a desired value map. In this example, the desired values TFP (Y1 and Y2) are calculated by inputting two signals of the quantity TE equivalent to an engine load and the engine rotational speed NE (the engine control parameters X1 and X2) to the desired value map.

Figure 5:
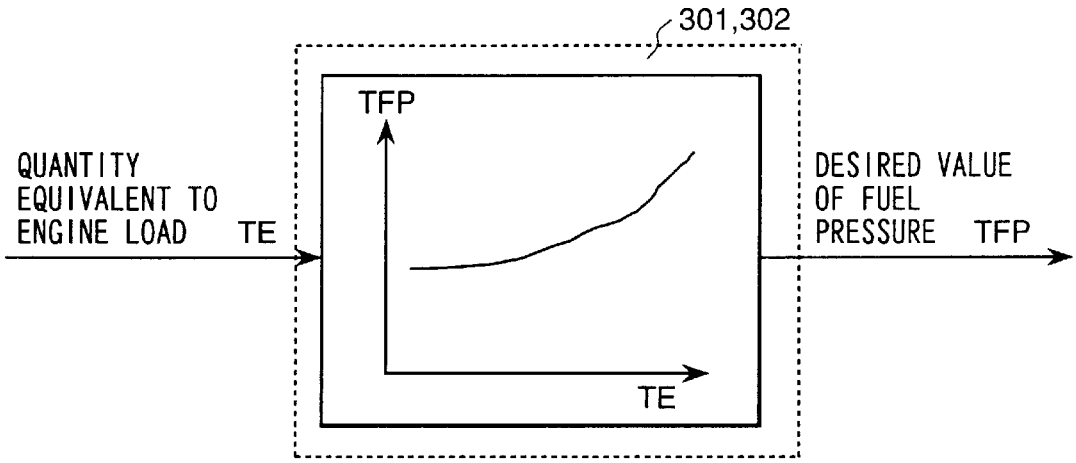
FIG. 5 is a diagram showing another example of a desired value map used by the means for calculating a desired value of a controlled variable in states A or B shown in FIG. 3.

FIG. 5 shows another example of calculating the desired values Y1 and Y2, which is performed by the means for calculating a desired value of a controlled variable in states A or B shown in FIG. 3, using a desired value table. In this example, the desired values TFP (Y1 and Y2) are calculated by inputting a signal of the quantity TE equivalent to an engine load (the engine control parameter X1) to the desired value table.

Figure 6:
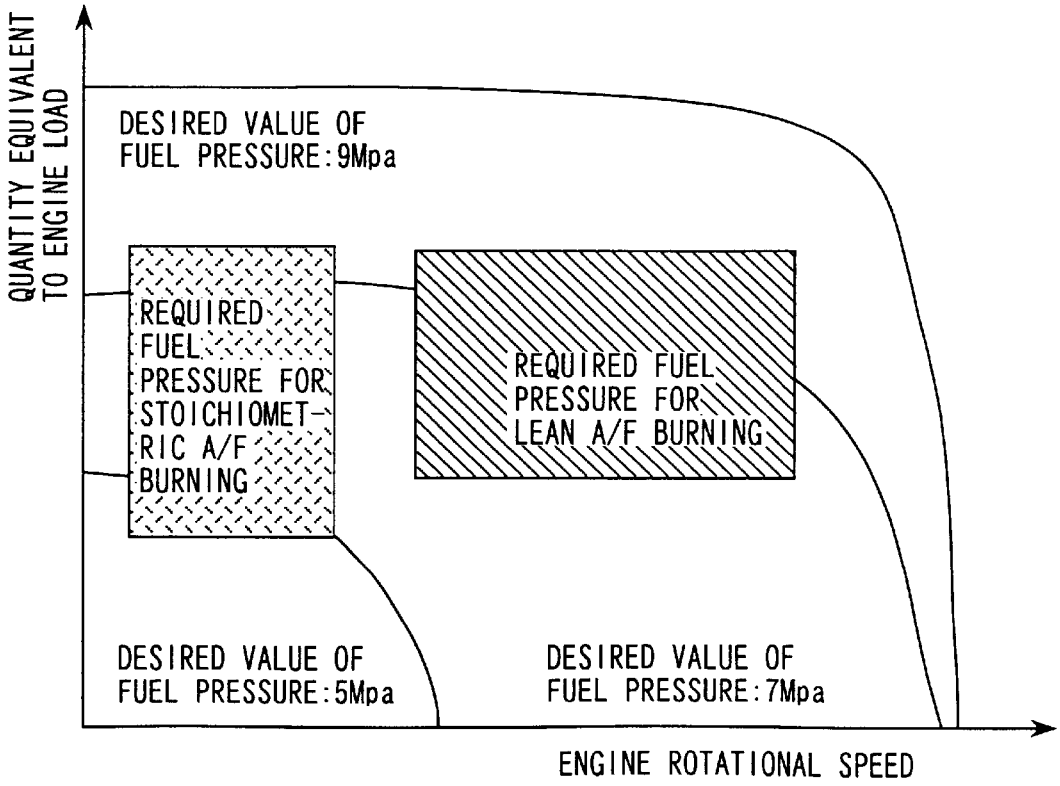
FIG. 6 is a diagram showing an example of setting a desired value of the fuel pressure in a map used by the means for calculating a desired value of a controlled variable in states A or B shown in FIG. 3.

FIG. 6 shows an example of regions for obtaining a desired value of fuel pressure, which are set in a map, used by the means for calculating a desired value of in states A or B. In the stoichiometric A/F burning regions, one of three values of 5, 7, and 9 MPa is set as a desired value of fuel pressure. On the other hand, in a lean A/F burning region, the same value of 6 MPa is set as a desired value of fuel pressure. These desired values of fuel pressure in the stoichiometric and lean A/F regions in the map are output from the means 301 and 302 for calculating a desired value of in states A and B.

Figure 7:
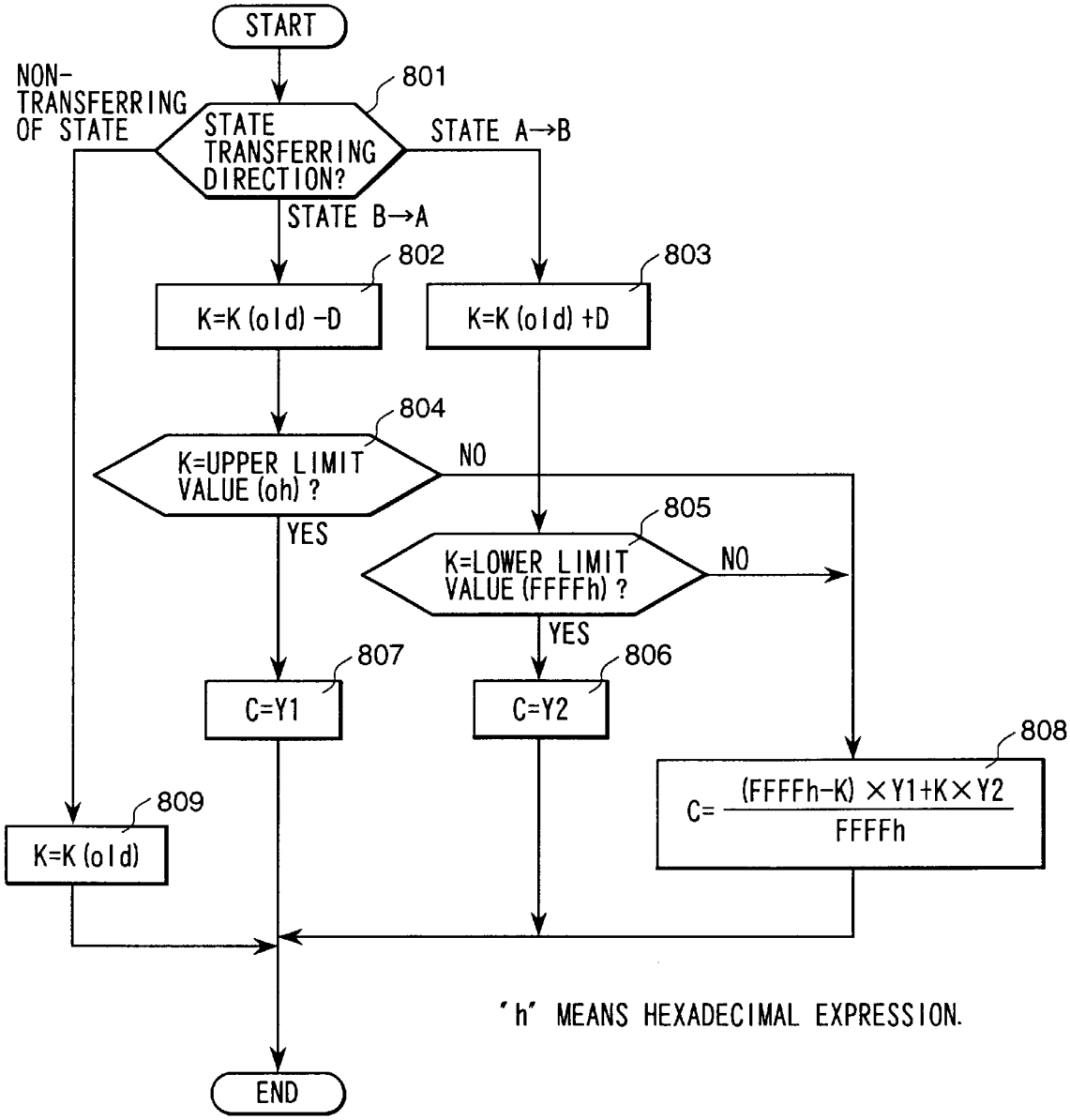
FIG. 7 is a flow chart of calculating an interpolation coefficient which is performed in the engine control apparatus shown in FIG. 3.

FIG. 7 shows a flow chart of repeatedly calculating an interpolation coefficient, which is performed by the state determination means 304, the means 305 for calculating an interpolation coefficient for an interpolated desired value of an controlled variable, and the means 303 for calculating an interpolated desired value of a controlled variable in the engine control apparatus shown in FIG. 3. In step 801, it is determined based on the result of the determination performed by the state determination means 304 whether or not the operation of the engine is under state transferring and in what direction the operational state is transferred if the operation of the engine is under state transferring. If the operation of the engine is not under state transferring, the processing goes to step 809, and the previous value K(old) of the interpolation coefficient is held. The interpolation coefficient K is basically changed only during state transferring.

If the operational state is transferred from the state B to the state A, the processing goes to step 802, and a new interpolation coefficient K is obtained by subtracting a predetermined decremental value D from the previous value K(old). In step 804, it is determined whether the interpolation coefficient K reaches the lower limit value (assumed as 0h). Here, "h" means hexadecimal expression. If the interpolation coefficient K has reached the lower limit value (assumed as 0h), the processing goes to step 807. In step 807, it is determined that the state transferring is completed, and the desired value Y1 obtained by the means 301 for calculating a desired value of a controlled value in a state A is set as the interpolated desired value C. Further, the processing is ended.

In a similar manner, in step 801, if the operational state is transferred from the state A to the state B, the processing goes to step 803. In step 803, a new interpolation coefficient K is obtained by adding a predetermined incremental value D to the previous value K(old), and the processing goes to step 805. In step 805, if the interpolation coefficient K has reached the upper limit value (assumed as FFFFh), it is determined that the state transferring is completed, and the desired value Y2 obtained by the means 302 for calculating a desired value of a controlled value in a state B is set as the interpolated desired value C. Further, the processing is ended.

If it is determined in steps 804 and 805 that the interpolation coefficient K does not reach the lower and upper limit values, in step 808, the interpolated desired value C is obtained using the equation $C=((FFFFh-K)\times Y1+K\times Y2)/FFFFh$. The above equation means that the interpolated desired value is obtained by interpolating the desired values Y1 and Y2 in the initial and final states in the state transferring control with the interpolation ratio $((1-K/FFFFh):K/FFFFh)$.

Although the present interpolation coefficient K is obtained by repeatedly adding or subtracting a predetermined incremental or decremental quantity D to or from the previous interpolation coefficient K(old) in the above flow chart, it is possible to combine this processing and another calculation processing of the incremental (decremental) quantity D.

Figure 8:
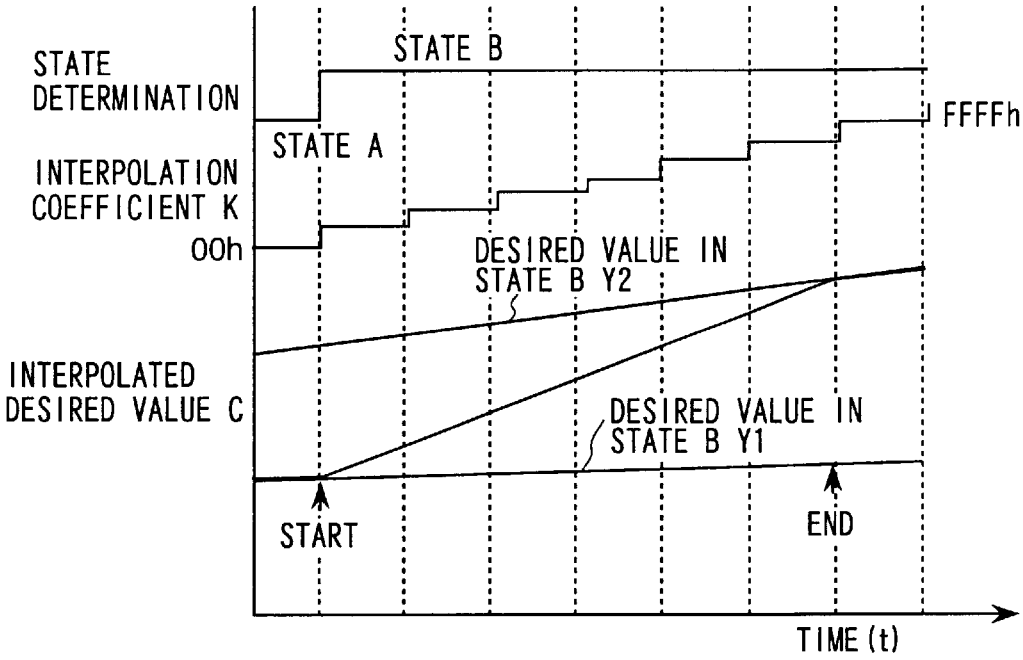
FIG. 8 is a time chart showing changes of parameters in the engine control apparatus shown in FIG. 3 during state transferring process of the operational state of the engine.

FIG. 8 is an example of a time chart showing changes of parameters in the engine control apparatus during state transferring of the state A to the state B. In the state A, the interpolation coefficient K is set as the lower limit value, for example, 0h, and the interpolated value C traces the desired value Y1. If it is determined that the operational state of the engine is switched to the state B, the interpolation coefficient K is repeatedly increased by the incremental quantity D, and the interpolated desired value C is calculated by interpolating the desired values Y1 and Y2 with the interpolation coefficient K. Thus, changes of the interpolated desired value K is indicated by the trajectory shown in FIG. 8.

If the interpolation coefficient K reaches the upper limit value FFFFh, it is determined that the state transferring is completed. Further, the interpolation coefficient K begins to trace the desired value Y2, and the state transferring control is ended.

Figure 9:
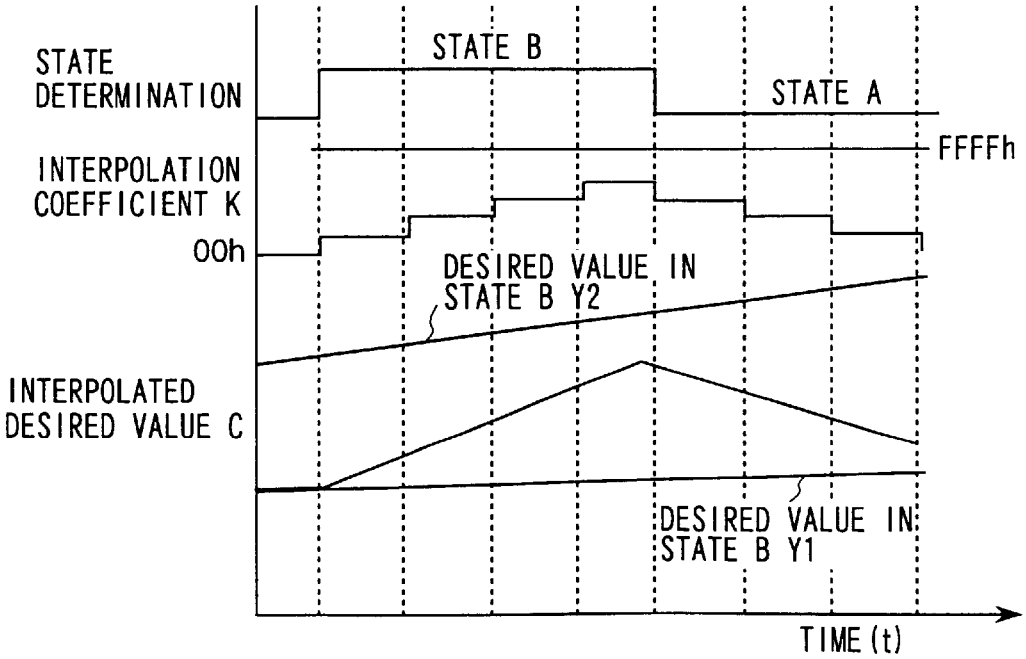
FIG. 9 is another time chart showing changes of parameters in the engine control apparatus shown in FIG. 3 during state transferring process of the operational state of the engine.

FIG. 9 shows another example of a time chart showing changes of parameters in the engine control apparatus while the operational state is transferred toward the state B, and is returned to the state A before the interpolation coefficient K reaches the upper limit value FFFFh indicating the completion of the state transferring. In this example also, the interpolated value C traces the desired value Y1 in the state A.

If it is determined that the operational state of the engine is switched to the state B. the interpolation coefficient K is repeatedly increased by the incremental quantity D, and the interpolated desired value C is calculated by interpolating the desired values Y1 and Y2 with the interpolation coefficient K, similar to the example shown in FIG. 8. Moreover, even if the direction of the state transferring is reversed, the interpolation coefficient K is calculated by taking the present direction of the state transferring into consideration. Thus, it is possible to continuously change the interpolation coefficient K without a step change of the coefficient K.

As mentioned above, even if comparatively frequent switching of the operation state is carried out, since the interpolation desired value C continuously changes between the desired values Y1 and Y2 by rendering the interpolation coefficient K correspond to changes of the operational state, a steep change of the interpolated desired value can be prevented.

Figure 10:
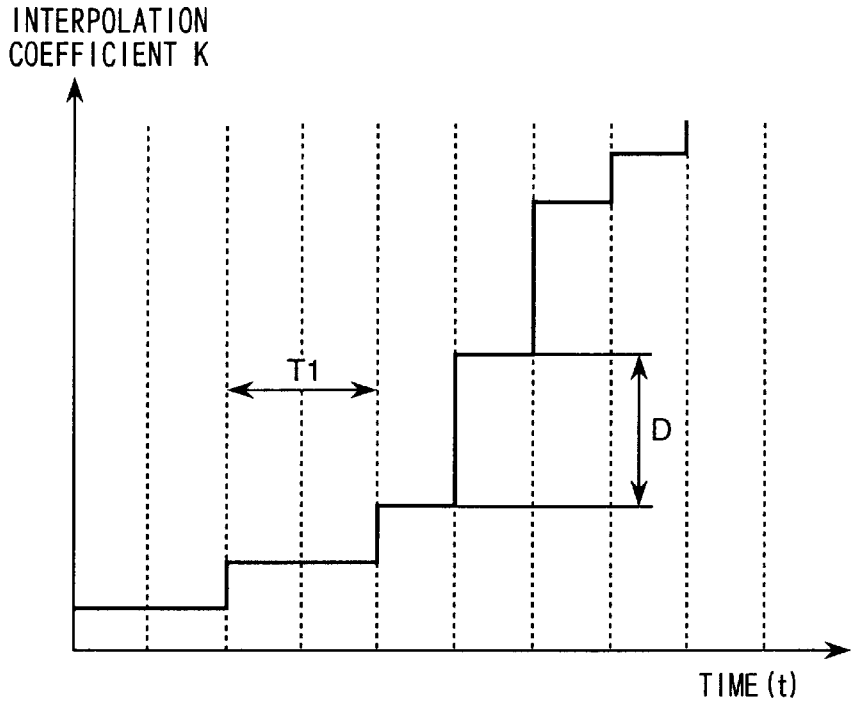
FIG. 10 is a diagram showing an example of calculating the interpolation coefficient K, which is performed by the engine control apparatus shown in FIG. 3.

FIG. 10 shows an example of a method of calculating the interpolation coefficient K. After it is determined that the required operational state is switched, the interpolation coefficient K is increased or decreased depending on the direction of the state transferring. Moreover, by changing the timing of changing the interpolation coefficient K with the incremental (decremental) quantity D (the calculation timing for the interpolation coefficient K) and the incremental quantity D, it is possible to flexibly change the gradient of the interpolation coefficient K, which improves the controllability of an engine.

Figure 11:
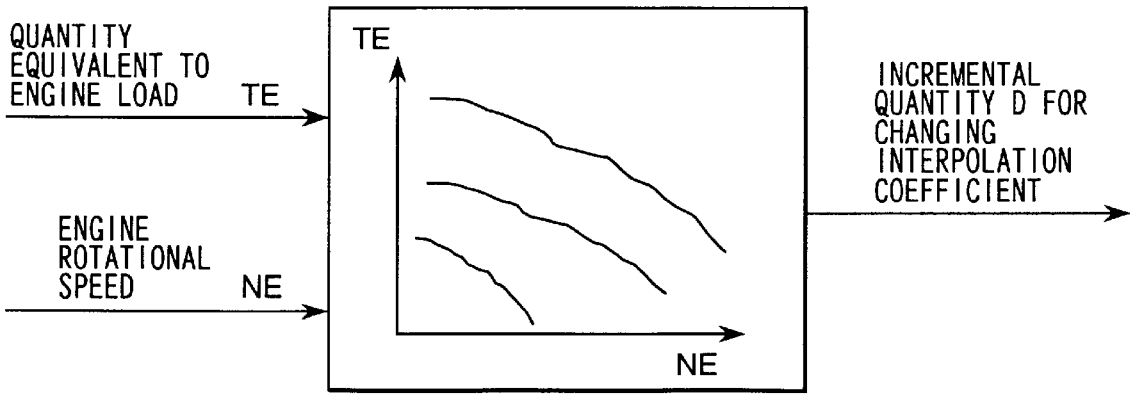
FIG. 11 is a diagram showing an example of obtaining an incremental quantity for obtaining the interpolation coefficient used in the engine control apparatus shown in FIG. 3.

FIG. 11 is a diagram showing an example of a map used to obtain an incremental (decremental) quantity D for the interpolation coefficient K. The quantity D is changed by searching the map expressed with control parameters of the quantity TE equivalent to an engine load and the engine rotational speed NE, corresponding to the operational condition or state. Further, it is possible to change the quantity D by a method searching a table. As the type of a quantity to innovatively change the interpolation coefficient K, the absolute value of the incremental quantify D or the gradient of a change of the interpolation coefficient K can be used.

Figure 12:
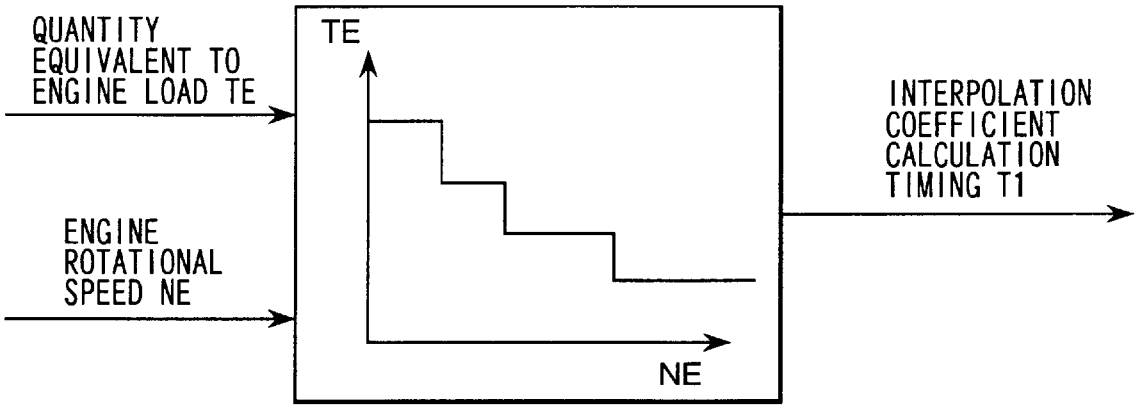
FIG. 12 is a diagram showing an example of determining a calculation timing T1 for calculating the interpolation coefficient used in the engine control apparatus shown in FIG. 3.

FIG. 12 shows an example of a map used to determine a calculation timing T1 of the interpolation coefficient K. The calculation timing T1 is obtained by searching the map described with control parameters of the quantity TE equivalent to an engine load and the engine rotational speed NE. Thus, it is possible to change the calculation timing T1 at which the incremental or decremental quantity D is added or subtracted to or from the previous interpolation coefficient K. Furthermore, it is possible to change the calculation timing T1 by a table searching method.

Figure 13:
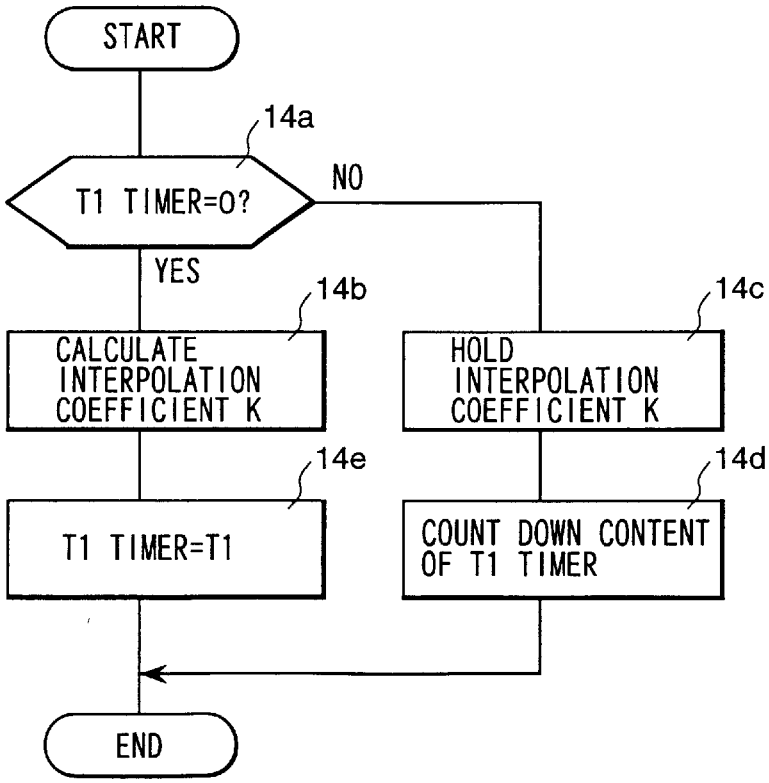
FIG. 13 is a flow chart of implementing the calculation timing T1 of the interpolation coefficient K used in the engine control apparatus shown in FIG. 3.

FIG. 13 shows a flow chart of materializing the calculation timing T1 of changing the interpolation coefficient K. If the interpolation coefficient K is calculated and changed based on a fundamental period which is implemented using a clock signal generated by a LSI timer, to determine the calculation timing is performed as the pre-processing for the calculation of the interpolation coefficient K.

T1 timer is set so that the content of the T1 timer becomes zero at the calculation timing T1 of changing the interpolation coefficient K, and in step 14*a*, it is determined every calculation period whether or not the content of the T1 timer is zero. If the content of the T1 timer is not zero, in step 14*c*, the previous value of the interpolation coefficient K is held without renewing the interpolation coefficient K, and in step 14*d*, the content of the T1 timer is counted down. If it is determined in step 14*a* that the content of the T1 timer is zero, that is, when the time corresponding to the calculation timing T1 obtained using the above map or table has lapsed, in step 14*b*, a new interpolation coefficient K is calculated, and the interpolation coefficient K is renewed. Further, instep 14*e*, the content of the T1 timer is initialized by setting the value of the next calculation timing T1 of changing the interpolation coefficient K to the T1 timer.

Figure 14:
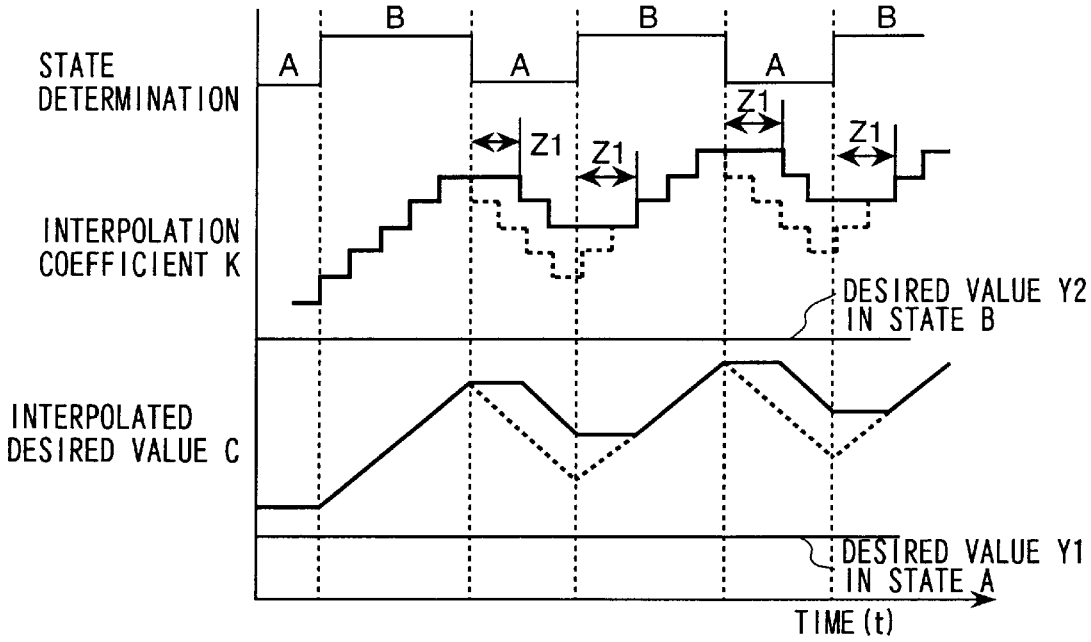
FIG. 14 is a time chart showing changes of parameters in the engine control apparatus shown in FIG. 3, in the case that a time delay function for starting the calculation of the interpolation coefficient K is provided.

FIG. 14 shows a time chart of changes in parameters of the engine in the case that a time delay function is provided for renewing the interpolation coefficient K, comparing with the case that a time delay function is not provided. As shown in this figure, without a time delay function, the interpolated desired value C changes as shown by the broken line in response to the state switching between the states A and B. On the other hand, with the time delay function, the interpolation coefficient K is not renewed until the delay time Z1 lapses from the time point at which the required operational state is switched from the state A to the state B, or from the state A to the state B, and the interpolated desired value change as shown by the solid line. Thus, the response characteristics of the interpolated desired value C can be changed so as to respond to frequent changes in the direction of state transferring, and the change amplitude of the interpolated desired value C can be also suppressed within a smaller amount.

Figure 15:
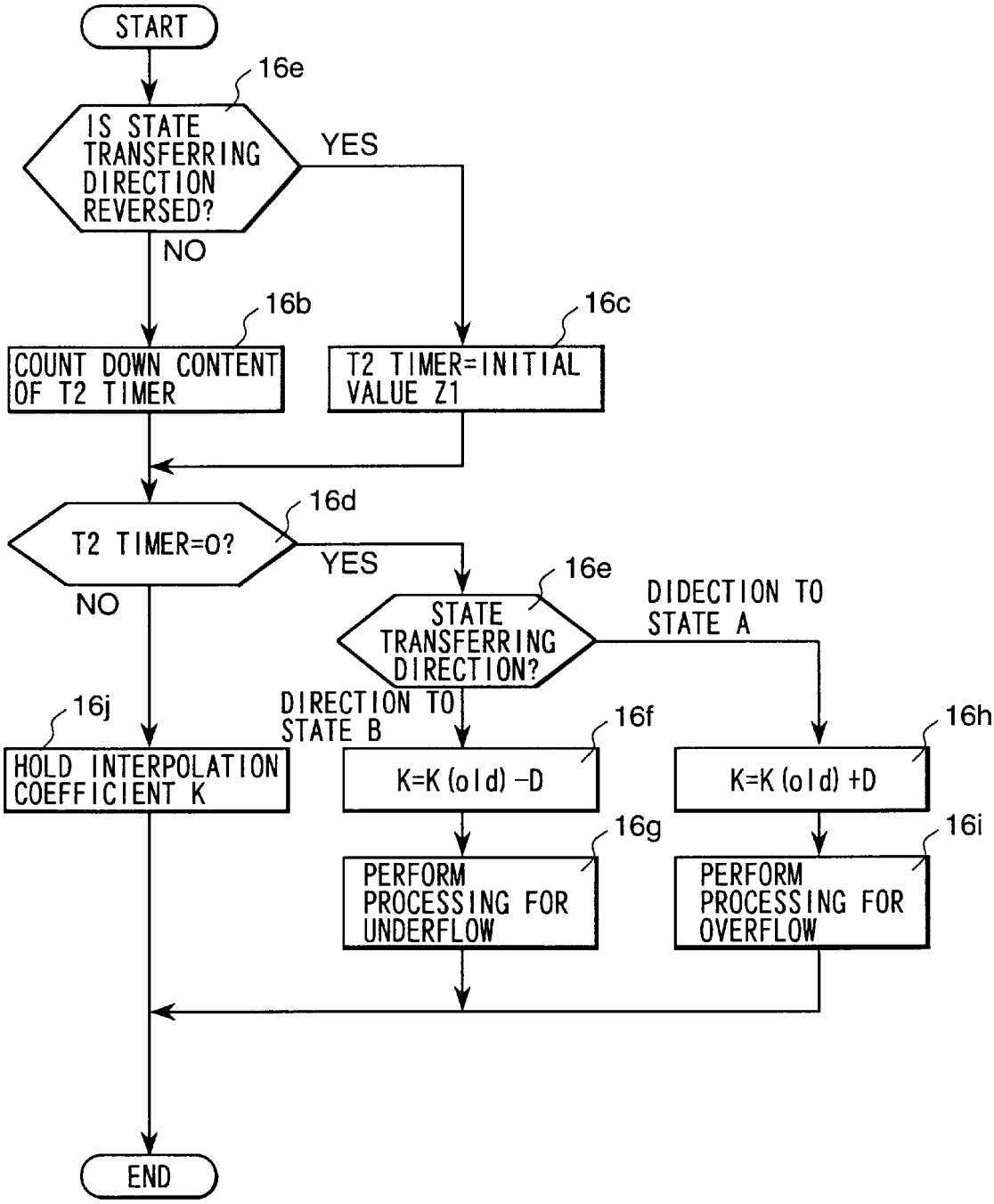
FIG. 15 is a flowchart of calculating the interpolation coefficient K performed by the engine control apparatus shown in FIG. 3, in the case a time delay function for starting the calculation of the interpolation coefficient K is provided.

FIG. 15 shows a flow chart of calculating the interpolation coefficient K, in the case that a time delay function is provided for renewing the interpolation coefficient K. At first, in step 16*a*, it is determined by the state determination means 304 whether or not the direction of the state transferring is reversed. When it is determined that the direction of the state transferring is reversed, in step 16*c*, the time delay value Z1 is set to the T2 timer for counting the delay time, as a initial value of the content of the T2 timer. If it is determined in step 16*c* that the direction of the state transferring is reversed, the processing goes to step 16*b*, and the content of the T2 timer is counted down. Next, in step 16*d*, it is determined whether or not the content of the T2 timer is zero, that is, the time Z1 has lapsed.

Meanwhile, the processing of the T2 timer in steps 16*b* and 16*c* can be replaced with setting zero to the T2 timer as the initial value and counting up the content of the T2 timer. In such processing, the processing in step 16*d* is changed to comparing the content of the T2 timer with the time delay value Z1.

In step 16*d*, if it is determined that the delay time Zl does not lapse, that is, the content of the T2 timer is not zero, in step 16*j*, the previous value K(old) is held without renewing the interpolation coefficient K. Conversely, if it is determined in step 16*d* that the delay time Z1 has lapsed, that is, the content of the T2 timer is zero, in step 16*e*, the direction of the state transferring is determined. If the direction of the state transferring is determined, in step 16*f* or 16*h*, the interpolation coefficient K is renewed by adding or subtracting the incremental or decremental quantity D to or from the previous interpolation coefficient K, depending on the determined direction of the state transferring. In step 16*g* or 16*i*, the processing for an underflow or an overflow is performed so that the renewed interpolation coefficient K does not exceed the lower or upper limit value. Thus, the calculation processing of the interpolation coefficient K with the time delay function, which is shown in FIG. 14, is materialized.

Figure 16:
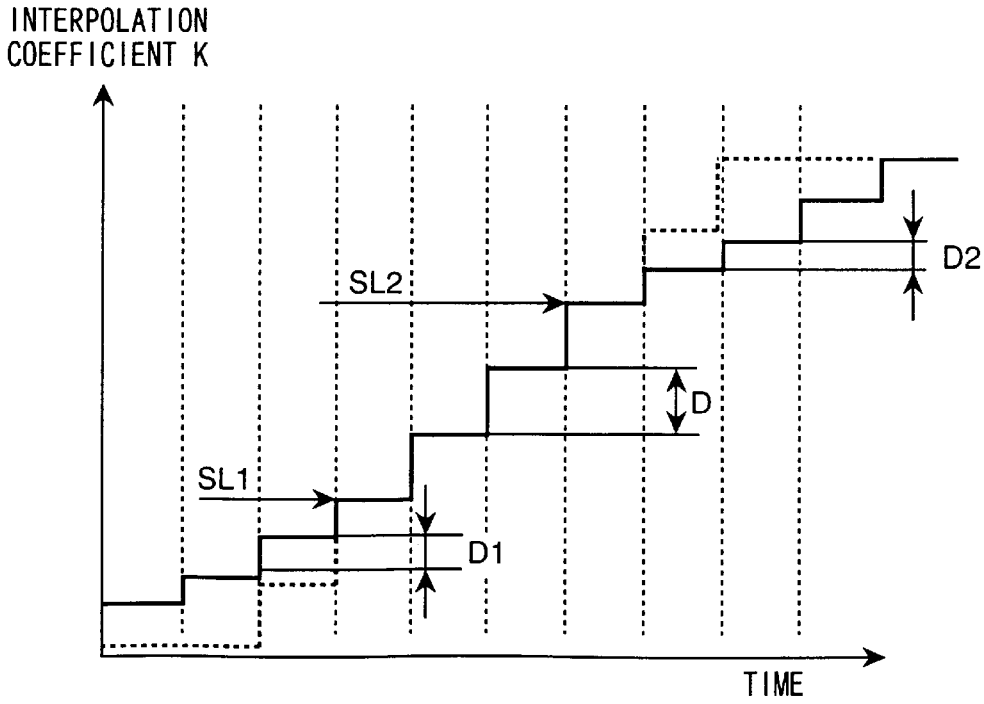
FIG. 16 is a diagram showing changes of the interpolation coefficient K calculated by the engine control apparatus shown in FIG. 3, in the case slice levels are provided to the interpolation coefficient.

FIG. 16 shows changes of the interpolation coefficient K to which slice levels are provided. In this case, although the interpolation coefficient K is renewed by adding or subtracting the incremental or decremental quantity d to or from the previous interpolation coefficient K, the coefficient K is renewed with another incremental (decremental) quantity when the coefficient K increases over a predetermined slice level, or decreases under another predetermined slice level. That is, although the incremental quantity D is used between the slice levels SL1 and SL2, the quantities D1 or D2 are used for the interpolation coefficient K above the slice level SL1 or below the slice level SL2, respectively. If only one incremental quantity D is used, the gradient (the rate of change) of changes of the interpolation coefficient K is constant. However, according to the above slice level method, the incremental (decremental) quantity becomes changeable, which improves the flexibility in the interpolation control.

Figure 17:
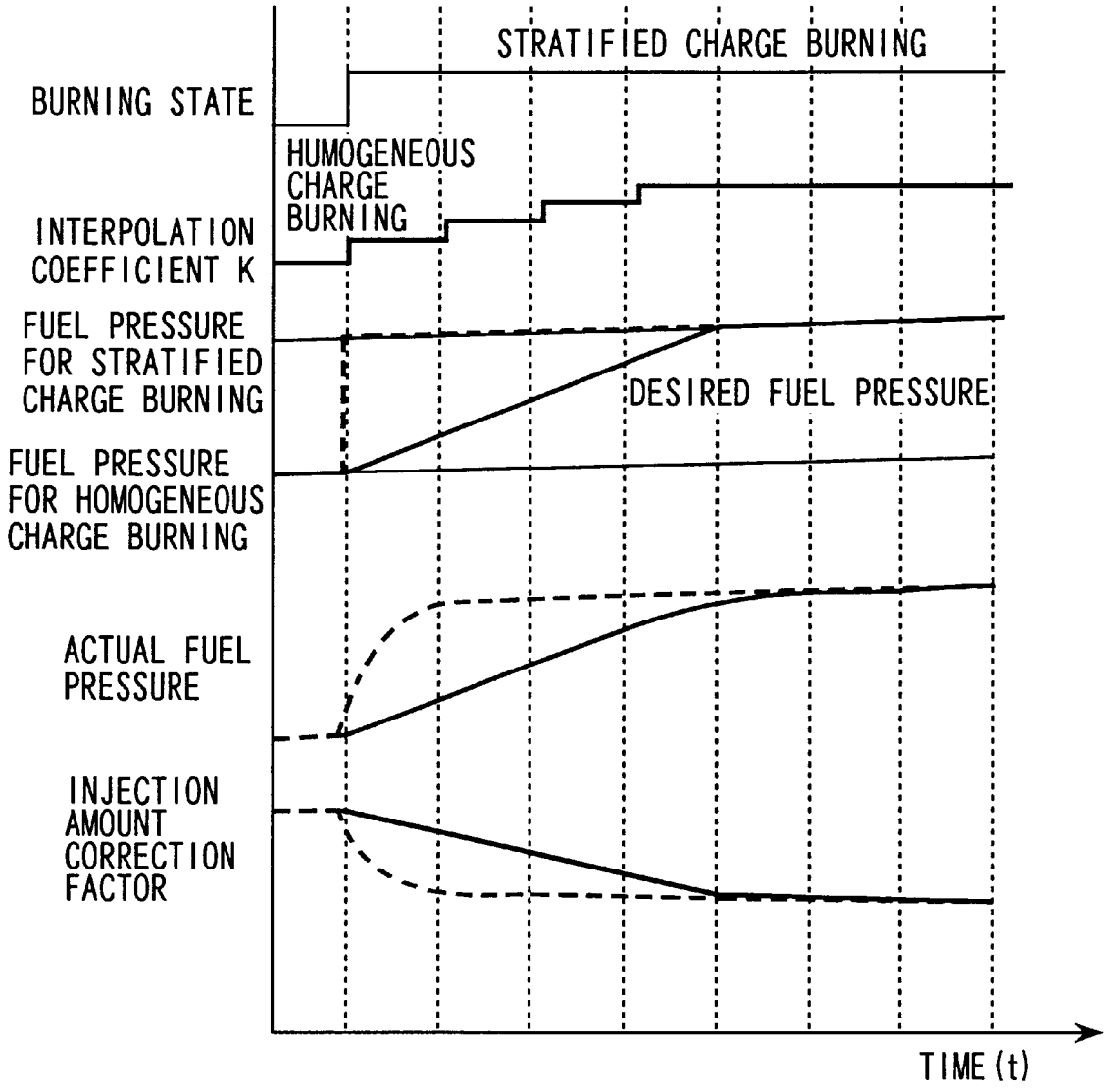
FIG. 17 is a diagram showing changes of the fuel pressure according to switching of the burning state of the engine, which is performed by the engine control apparatus shown in FIG. 3.

FIG. 17 shows changes of the fuel pressure according to switching of the required burning state in the engine. In a direct injection engine, since the burning state in the stoichiometric A/F burning (homogeneous charge burning) differs from that in the lean A/F burning (stratified charge burning), the desired values of fuel pressure in the above respective burning state is different from each other.

Accordingly, if the required burning state of the engine is switched from the homogeneous charge burning to the stratified charge burning as shown in FIG. 17, the desired value of fuel pressure is smoothly changed with the above interpolation coefficient K. Thus, rapid changes of fuel pressure can be avoided, which can prevent stopping of fuel burning or engine shock. Further, if changes of fuel pressure are smooth, the actual correction factor for a contribution ratio of fuel pressure to the injection amount can be easily detected, which improves the controllability of the engine.

Application of the engine control apparatus including an interpolation control means according to the present invention is not restricted to the above described embodiments, and various alterations or changes of this engine control apparatus are possible in materializing the present invention within the scope of claims.

For example, although the fuel burning operation of an engine is controlled by the engine control apparatus of the present invention in the above embodiments, this engine control apparatus including an interpolation control means according to the present invention is applicable to control switching of a desired value of a controlled variable from one operation state to that of another operational state in a different kind of operation. Moreover, the engine control apparatus of the present invention is also applicable to control the transmission control device 125 of the automatic transmission 126 shown in FIG. 1 besides the engine system.

As mentioned above, since the engine control apparatus including an interpolation control means according to the present invention includes the interpolation control means for interpolating two different desired values of a controlled variable, in an engine control in which a desired value of a controlled variable is changed according to changes of an operational state of an engine, when the required operational state of the engine is switched, it is possible to smoothly change the desired value of the controlled variable between the two desired values in the two different operational states.

What is claimed is:

1. An engine control apparatus comprising:

an interpolation control unit including;

desired value calculation means for calculating a desired value of a controlled variable corresponding to each operational state based on related control parameters of an engine;

determination means for determining changes of an operational state of said engine;

interpolation coefficient calculation means for calculating an interpolation coefficient of said controlled variable for an interpolated desired value of said controlled variable between desired values in a first operational state and a second operational state to which said operational state of said engine is switched from said first operational state; and interpolated desired value calculation means for calculating an interpolated desired value of said controlled variable based on said interpolation coefficient and two desired values of said controlled variable in said first and second operational states wherein said interpolation control unit controls said controlled variable in switching of a required operational state from said first state to said second state in said engine with said interpolated desired value whose changes are obtained by said interpolated desired value calculation means corresponding to an operational state determined by said state determination means and said timing of adding said incremental quantity to a present interpolation coefficient optionally is set by searching a map or a table.

2. An engine control apparatus comprising:

an interpolation control unit including;

desired value calculation means for calculating a desired value of a controlled variable corresponding to each operational state based on related control parameters of an engine;

determination means for determining changes of an operational state of said engine;

interpolation coefficient calculation means for calculating an interpolation coefficient of said controlled variable for an interpolated desired value of said controlled variable between desired values in a first operational state and a second operational state to which said operational state of said engine is switched from said first operational state; and interpolated desired value calculation means for calculating an interpolated desired value of said controlled variable based on said interpolation coefficient and two desired values of said controlled variable in said first and second operational states wherein said interpolation control unit controls said controlled variable in switching of a required operational state from said first state to said second state in said engine with said interpolated desired value whose changes are obtained by said interpolated desired value calculation means corresponding to an operational state determined by said state determination means and said interpolation coefficient is renewed with a time delay after a required operational state is switched.

3. An engine control apparatus comprising:

an interpolation control unit including;

desired value calculation means for calculating a desired value of a controlled variable corresponding to each operational state based on related control parameters of an engine;

determination means for determining changes of an operational state of said engine;

interpolation coefficient calculation means for calculating an interpolation coefficient of said controlled variable for an interpolated desired value of said controlled variable between desired values in a first operational state and a second operational state to which said operational state of said engine is switched from said first operational state; and interpolated desired value calculation means for calculating an interpolated desired value of said controlled variable based on said interpolation coefficient and two desired values of said controlled variable in said first and second operational states and an upper limit value and a lower limit value are provided for obtaining said interpolation coefficient.

4. An engine control apparatus comprising:

an interpolation control unit including;

desired value calculation means for calculating a desired value of a controlled variable corresponding to each operational state based on related control parameters of an engine;

determination means for determining changes of an operational state of said engine;

interpolation coefficient calculation means for calculating an interpolation coefficient of said controlled variable for an interpolated desired value of said controlled variable between desired values in a first operational state and a second operational state to which said operational state of said engine is switched from said first operational state; and interpolated desired value calculation means for calculating an interpolated desired value of said controlled variable based on said interpolation coefficient and two desired values of said controlled variable in said first and second operational states said interpolation control unit controls said controlled variable in switching of a required operational state from said first state to said second state in said engine with said interpolated desired value whose changes are obtained by said interpolated desired value calculation means corresponding to an operational state determined by said state determination means, said interpolation coefficient is obtained by repeatedly adding or subtracting an optionally set incremental or decremental quantity to or from an initial value of said interpolation coefficient corresponding to switching of an operational state of said engine and quantity when said interpolation coefficient changes beyond a predetermined slice level.

5. An engine control apparatus comprising:

an interpolation control unit including;

desired value calculation means for calculating a desired value of fuel pressure corresponding to each burning state based on a quantity equivalent to an engine loan and an engine rotational speed;

determination means for determining changes in a burning state of an engine;

interpolation coefficient calculation means for calculating an interpolation coefficient for an interpolated desired value of fuel pressure between desired values in a first burning state and a second burning state to which a burning state of said engine is switched from said first burning state;

interpolated desired value calculation means for calculating an interpolated desired value of fuel pressure based on said interpolation coefficient and two desired values of fuel pressure in said first and second burning states;

wherein said interpolation control unit controls the fuel pressure in switching of a required burning state from said first state to said second state in said engine with said interpolated desired value of fuel pressure, whose changes are obtained by said interpolated desired value calculation means corresponding to a burning state determined by said state determination means, wherein said timing of adding said incremental quantity to a present interpolation coefficient optionally is set by search a map or a table.

6. An engine control apparatus comprising:

an interpolation control unit including;

desired value calculation means for calculating a desired value of fuel pressure corresponding to each burning state based on a quantity equivalent to an engine loan and an engine rotational speed;

determination means for determining changes in a burning state of an engine;

interpolation coefficient calculation means for calculating an interpolation coefficient for an interpolated desired value of fuel pressure between desired values in a first burning state and a second burning state to which a burning state of said engine is switched from said first burning state;

interpolated desired value calculation means for calculating an interpolated desired value of fuel pressure based on said interpolation coefficient and two desired values of fuel pressure in said first and second burning states;

wherein said interpolation control unit controls the fuel pressure in switching of a required burning state from said first state to said second state in said engine with said interpolated desired value of fuel pressure, whose changes are obtained by said interpolated desired value calculation means corresponding to a burning state determined by said state determination means, wherein said interpolation coefficient is renewed with a time delay after a required operational state is switched.

7. An engine control apparatus comprising:

an interpolation control unit including;

desired value calculation means for calculating a desired value of fuel pressure corresponding to each burning state based on a quantity equivalent to an engine loan and an engine rotational speed;

determination means for determining changes in a burning state of an engine;

interpolation coefficient calculation means for calculating an interpolation coefficient for an interpolated desired value of fuel pressure between desired values in a first burning state and a second burning state to which a burning state of said engine is switched from said first burning state;

interpolated desired value calculation means for calculating an interpolated desired value of fuel pressure based on said interpolation coefficient and two desired values of fuel pressure in said first and second burning states;

wherein said interpolation control unit controls the fuel pressure in switching of a required burning state from said first state to said second state in said engine with said interpolated desired value of fuel pressure, whose changes are obtained by said interpolated desired value calculation means corresponding to a burning state determined by said state determination means, wherein an upper limit value and a lower limit value are provided for obtaining said interpolation coefficient.

* * * * *